US005796212A

United States Patent [19]

Tonegawa

[11] Patent Number: 5,796,212

[45] Date of Patent: Aug. 18, 1998

[54] LINEAR BEAM MICROWAVE TUBE WITH PLANAR COLD CATHODE ELECTRODE AS ELECTRON BEAM SOURCE

[75] Inventor: Satoshi Tonegawa, Tokyo, Japan

[73] Assignee: NEC Corporation, Tokyo, Japan

[21] Appl. No.: 739,782

[22] Filed: Oct. 30, 1996

[30] Foreign Application Priority Data

Oct. 31, 1995 [JP] Japan ..... 7-282938

[51] Int. Cl.[6] ..... H01J 23/083

[52] U.S. Cl. ..... 315/5.33; 315/5.34; 313/452; 313/414

[58] Field of Search ..... 315/3, 5.33, 5.34; 313/308, 414, 447, 452

[56] References Cited

U.S. PATENT DOCUMENTS

| | | | |
|---|---|---|---|
| 2,842,703 | 7/1958 | Priest | 315/3 |
| 3,116,435 | 12/1963 | Heil | 315/5.34 X |
| 4,182,628 | 1/1980 | D'Silva | 428/673 X |
| 4,825,121 | 4/1989 | Miyazaki | 313/447 X |
| 5,514,847 | 5/1996 | Makishima et al. | 313/308 X |
| 5,604,401 | 2/1997 | Makishima | 315/3 |
| 5,623,183 | 4/1997 | Allen et al. | 315/5.34 X |

FOREIGN PATENT DOCUMENTS 5-343000 12/1993 Japan .

OTHER PUBLICATIONS

C.A. Spindt et al., "Progress in Field-Emitter Array Development for High-Frequency Operation", *IEDM 93*, 1993, pp. 749–752.

R.K. Parker, "Vacuum-Microelectronics Technology for RF Power Devices", *IVMC Technical Digest*, Jul. 12, 1993, pp. 1–4.

*Primary Examiner*—Robert J. Pascal
*Assistant Examiner*—Justin P. Bettendorf
*Attorney, Agent, or Firm*—Sughrue, Mion, Zinn, Macpeak & Seas, PLLC

[57] ABSTRACT

An electron gun using a plane type cold cathode electrode has a beam focusing electrode which is disposed in front of the plane type cold cathode electrode and has a hole having a diameter smaller than an electron emission region. The beam focusing electrode is in direct contact with a cathode chip constituting the plane type cold cathode electrode, thus realizing direct electrical connection between the cold cathode chip and the beam focusing electrode. The arrangement enables the converging of an electron beam from the cold cathode electrode to a desired shape and the accurate setting of the center of a beam orbit to a desired position.

5 Claims, 10 Drawing Sheets

LINEAR BEAM MICROWAVE TUBE WITH PLANAR COLD CATHODE ELECTRODE AS ELECTRON BEAM SOURCE

BACKGROUND OF THE INVENTION (1) Field of the Invention

The present invention relates to linear beam microwave tubes which are operable by the interaction between an electron beam and a microwave, and more particularly to the structure of an electron gun section using a planar cold cathode electrode as an electron beam source.

(2) Description of the Related Art

Microwave power finds extensive applications to various fields such as communication, laser, industrial heating, particle accelerators, radio astronomy, and nuclear fusion. In order to meet the demands of society to realize a high level information society as we approach the 21st century and also organize a new society system realizing mutual transfer of large-scale digital data typically represented by multi media, the fields concerning communication, among the fields mentioned above, are becoming to fulfill increasingly important roles.

Among various types of communication, one using microwaves employs microwave transmission stations which are used in satellite communication earth stations or in satellites themselves. Among sub-systems of such a transmission station, linear beam microwave tubes are used as typical microwave amplifiers.

A linear beam microwave tube comprises an electron gun section for emitting an electron beam, a high frequency circuit section including a slow-wave circuit for causing interaction between an electron beam and a microwave, a collector section for collecting the electron beam that has completed the interaction process at the high frequency circuit section, and a beam focusing electrode for converging the electron beam. Among the constituent elements of the above linear beam microwave tube, the electron gun which generates an electron beam having a constant beam diameter is very important for stable operation of the tube.

Conventionally, a hot cathode electrode has been used as the cathode electrode of the electron gun section, where the hot cathode electrode is heated to a temperature of about 1,000° C. In addition, a complex structure is necessary for supporting the cathode electrode at the high temperature. Recently, research and development has been made to develop electron guns using a cold cathode electrode. FIG. 1 is a schematic sectional view showing such a conventionally developed electron gun using a cold cathode electrode. As shown, a cold cathode electrode 44 is provided in a cathode chip 39, which is brazed to a mount support 43. A beam focusing electrode 12 for converging the electron beam is disposed at a predetermined distance from the front of the cathode chip 39. The beam focusing electrode 12 has a hole greater than the electron emission region 57 of the cold cathode electrode. The cold cathode electrode has its gate electrode led out by a wire bonding 60.

FIG. 2 is a perspective view showing the cathode chip 39. A cold cathode electrode for emitting the electron beam is designated at 38. A large number of these cold cathode electrodes 38 constitute the electron emission region 57. The cold cathode electrodes are fabricated by as well-known semiconductor processes. FIG. 3 is an enlarged-scale sectional view showing the cold cathode electrode. As shown in FIG. 3, a gate electrode 41 is provided on a base substrate 56 via an insulating layer 42. A hole is formed in the gate electrode 41 and the insulating layer 42, and a conical emitter 40 is formed in the hole. By applying a voltage to the gate electrode 41 and applying a high electric field to the emitter tip, electrons are emitted therefrom.

In the above described prior art electron gun using the cold cathode electrode, the cathode chip is brazed to the mount support, and the electron beam is converged by the beam focusing electrode having a hole whose diameter is not smaller than the electron emission region. A problem therein is that, as shown in FIG. 1, the emitted electron beam becomes eccentric depending on the relative positions of the cathode chip and the beam focusing electrode. The electron emission region in which the cold cathode electrodes are formed, is about 1 mm×1 mm, and this means that it is difficult to discriminate the region by visual observation. Therefore, during the fabrication, it is difficult to position the electron emission region appropriately and the high frequency circuit of the microwave tube relative to each other.

In the case of a traveling-wave of a milli-wave band progressive wave tube, for instance, the electron emission region of the cold cathode electrode is about 1 mm×1 mm. This means that the helix diameter in the case of a helix type slow-wave circuit which is a typical high frequency circuit is 0.5 mm or below. In this case, 99.5% of an electron beam of 100 mA, for instance, has to be transmitted to the collector without interrupting the helix circuit of 0.5 mm or below in radius.

A position deviation of the cathode and the high frequency circuit by 10 μm (i.e., 0.01 mm) corresponds to a 2% position deviation with respect to a the helix of 0.5 mm. Operating the microwave tube in this state results in striking of the helix circuit by part of the electron beam emitted from the cathode, and the consequent deterioration of the vacuum degree due to gas generation as a result of partial heating may have adverse effects on the transmission of the electron beam. Moreover, when it is struck by the concentrated electron beam, the helix circuit is melt down. In such a case, the microwave tube will no longer fulfill its function.

Japanese Patent Application Kokai Publication No. Hei 5-343000 discloses an electron gun and cathode electrode, wherein a plurality of beam focusing electrodes are provided in front of an electron emission region. The beam focusing electrodes are provided with insulating materials respectively interposed so that they are not in direct contact with the gate electrodes to which the voltage is applied for the emission of electrons from the electron emission region. In the structure disclosed, the hole defined by the beam focusing electrodes is not shown as having a smaller diameter than the electron emission region but shown as having an approximately equal diameter as that of the electron emission region.

With the prior art arrangements described above, the electron beam and the high frequency circuit are axially deviated from each other, and this leads to various problems resulting from the deterioration of the beam transmission.

SUMMARY OF THE INVENTION

An object of the invention, therefore, is to overcome the various drawbacks discussed above which are inherent in the prior art, and to provide a linear beam microwave tube which enables the converging of an electron beam from a cold cathode electrode to a desired shape and the accurate alignment of the beam orbit center to a desired position.

According to one aspect of the invention, there is provided a linear beam microwave tube having an electron gun section serving as an electron beam source, a high frequency circuit section including a slow-wave circuit for causing interaction between an electron beam and a microwave, and a collector section for collecting the electron beam produced as a result of the interaction process in the high frequency circuit section, the linear beam microwave tube comprising:

a cathode chip constituting a plane type cold cathode electrode having no heater in the electron gun section and having an electron emission region; and a beam focusing electrode being in direct contact with the cathode chip and disposed in front of the plane type cold cathode electrode and having a hole whose diameter is smaller than the electron emission region of the plane type cold cathode electrode.

According to the invention, the linear beam microwave tube comprises the electron gun using a cold cathode electrode not requiring any heater, the cold cathode electrode being carried by the cathode chip that is abutted and brazed to a mount support, and the cathode chip being positioned with respect to the reference position of the mount support to meet a desired size.

The electron beam is converged by the beam focusing electrode having the hole whose diameter is smaller than the electron emission region of the cold cathode electrode, whereby a circular electron beam having a diameter the same as the hole diameter of the beam focusing electrode can be directly taken out.

The beam focusing electrode is in direct contact with the cathode chip, thus dispensing with leads for leading a gate electrode from the cathode chip when the cathode chip is mounted. It is thus possible to construct, without requiring such processes as those for wire bonding, a desired electron gun capable of producing an electron beam which has a circular profile in a cross-sectional view perpendicular to its axial direction and which is free from axial deviation.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Figure 4:
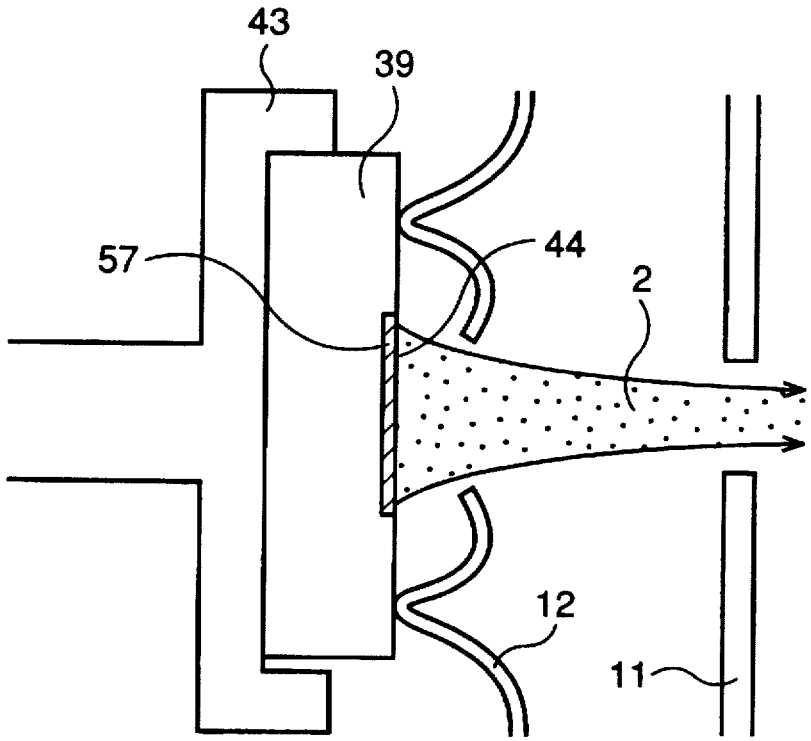
FIG. 4 is a sectional view showing an electron gun section of a linear beam microwave tube according to a first embodiment of the invention.

The invention will now be described with reference to the drawings. FIG. 4 is a sectional view showing an electron gun section of a first embodiment of the linear beam microwave tube according to the invention. Specifically, FIG. 4 shows a cold cathode electrode 44, a cathode chip 39 therefor, a mount support 43, and a beam focusing electrode 12 for converging an electron beam.

Figure 5:
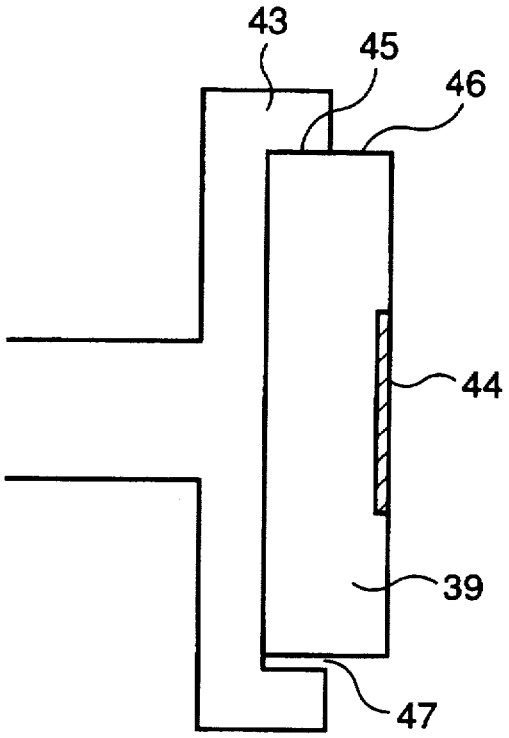
FIG. 5 is a sectional view showing brazed portions of a mount support and a cathode chip.

As shown in FIG. 5, in the fabrication of an electron beam emission part including the cold cathode electrode 44, the cathode chip 39 including the cold cathode electrode 44 and the mount support 43 which supports the cathode chip 39 are preliminarily abutted and brazed. As shown in FIG. 5, one of opposite edges, i.e., edge 46, of the cathode chip 39 is brazed to a reference face 45 of the mount support 43, while a clearance 47 is formed between the other edge of the cathode electrode and the mount support. With this arrangement of contact of one side of the cathode chip 39 with the reference face 45 of the mount support 43 and provision of the clearance on the other side, the cold cathode electrode 44 can be positioned so as to meet desired dimensions.

To obtain the structure as shown in FIG. 5, the brazing of the cathode chip 39 and the mount support 43 is made by taking the heat resistance of the cold cathode electrode 44 into due consideration. Specifically, it is done by using a silver paste and in a temperature range not exceeding about 300° C., which is the lowest temperature experienced in the usual process of fabrication of the cold cathode electrode 44.

Figure 6:
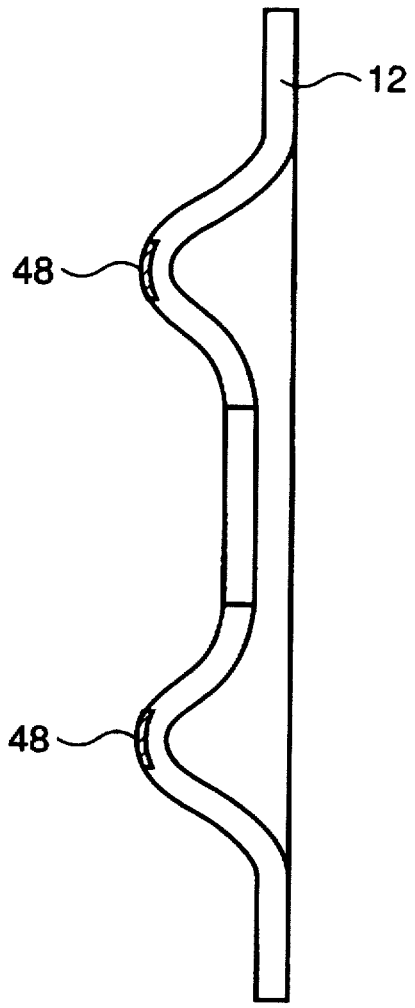
FIG. 6 is a sectional view showing a preliminarily fabricated beam focusing electrode.

The beam focusing electrode 12 is mounted in the following ways. As shown in FIG. 6, indium (In) plating 48 is preliminarily provided on contact portions of the beam focusing electrode 12 having the illustrated shape to be in contact with the cathode chip 39. This beam focusing electrode 12 is held in contact with the cathode chip 39 and pressed while being heated to connect the focus electrode to the gate surface of the cathode, whereby an electrical contact is obtained. The contact obtained in this process is not a mere contact between metals but is a thermal press contact, and thus permits satisfactory electrical connection to be maintained under environmental conditions subject to vibrations, shocks, etc.

Figure 7:
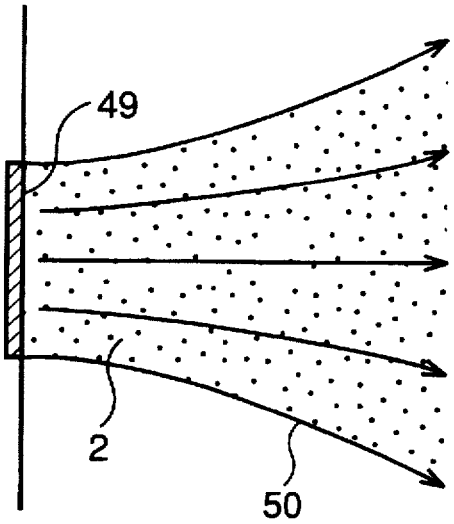
FIG. 7 is a view showing an orbit of an electron beam emitted from a plane electron emission region.
Figure 8:
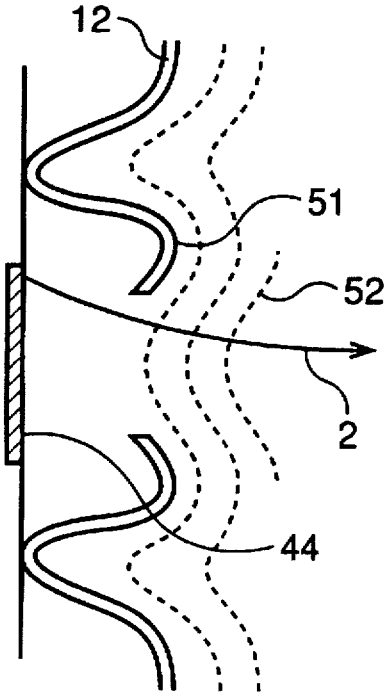
FIG. 8 is a view showing a relation between the plane electron emission region and the beam focusing electrode.

Even where the electron emission surface is plane, the reason that an electron beam emitted from an electron emission surface is caused to be converged to a desired laminar flow beam may be explained as follows. As shown in FIG. 7, without beam focusing electrode 12, the electron beam 2 emitted from an electron emission region 49 which is in the form of a plane, is not converged to one having a laminar flow property but increases its diameter 50 as it advances due to space charge forces generated by repelling forces of negative charge of electrons. As shown in FIG. 8, with the provision of the beam focusing electrode 12 which has a concave portion 51 on its side opposite the cold cathode electrode 44, equipotential lines 52 are bent along the surface of the concave portion 51. As the electron beam 2 proceeds in a direction perpendicular to the equipotential lines 52, it can be converged to a desired shape.

Figure 9:
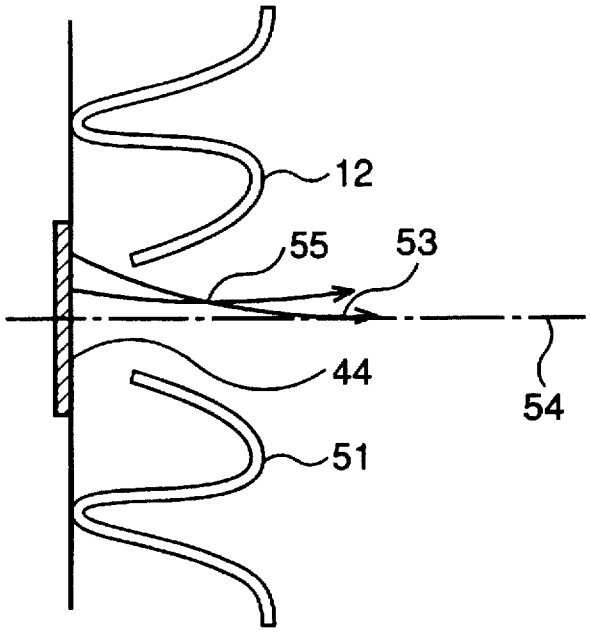
FIG. 9 is a view showing a case wherein the beam focusing electrode has an excessively deep convex portion.
Figure 10:
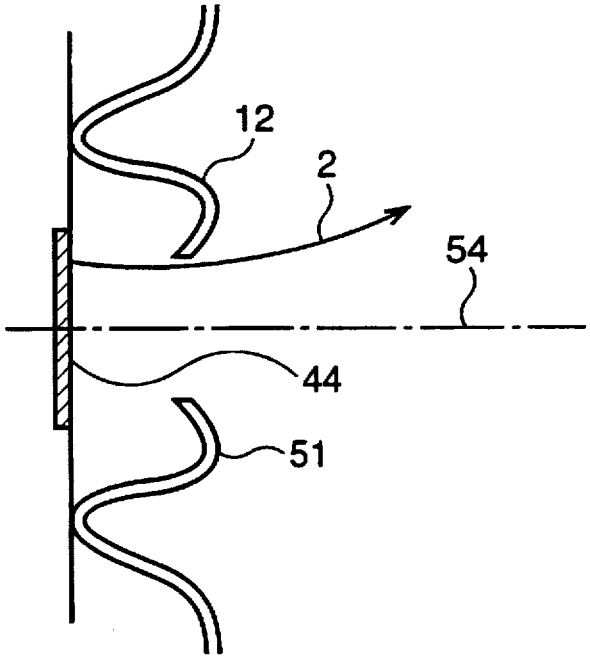
FIG. 10 is a view showing a case wherein the beam focusing electrode has an insufficiently deep convex portion.

As shown in FIG. 9, with a beam focusing electrode 12 with the concave portion 51 having an increased depth, outermost electrons 53 in the electron beam 2 are brought to the neighborhood of the axis 54 of the cold cathode electrode 44, thus forming an intersection 55 of the electron beam to deteriorate the laminar flow property thereof. As shown in FIG. 10, an insufficient depth of the concave portion 51 conversely results in insufficient converging of the electron beam 2, so that it is impossible to produce an electron beam having a desired shape. It will be seen that the shape of the concave portion 51 of the beam focusing electrode 12 is determined by the current rate, voltage and desired diameter of the electron beam 2.

Figure 11:
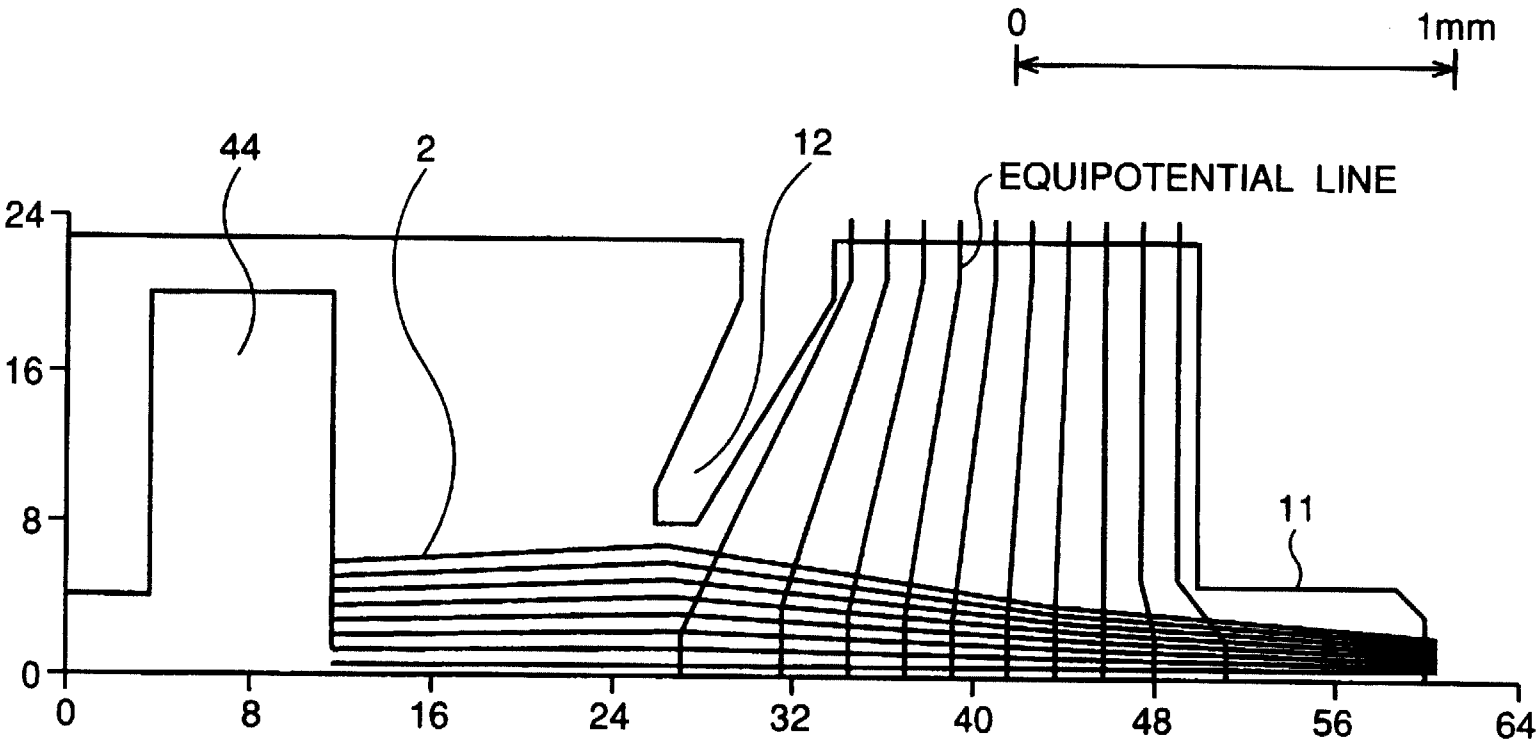
FIG. 11 is a view showing computer simulations of a beam focusing electrode end and beam orbits.

Specific dimensions and materials which the first embodiment of the invention are realized with, are as follows. FIG. 11 shows computer simulations of beam focusing electrode end shapes and electron beam orbits. The electron beam 2 emitted from the cold cathode electrode 44 is converged by the beam focusing electrode 12 as illustrated in FIG. 11. In FIG. 11, actual dimensions are shown as reference dimensions (in a unit of 1 mm for each of 20 graduations in both the vertical and horizontal axes) for the clarity of the electrode size.

Figure 1:
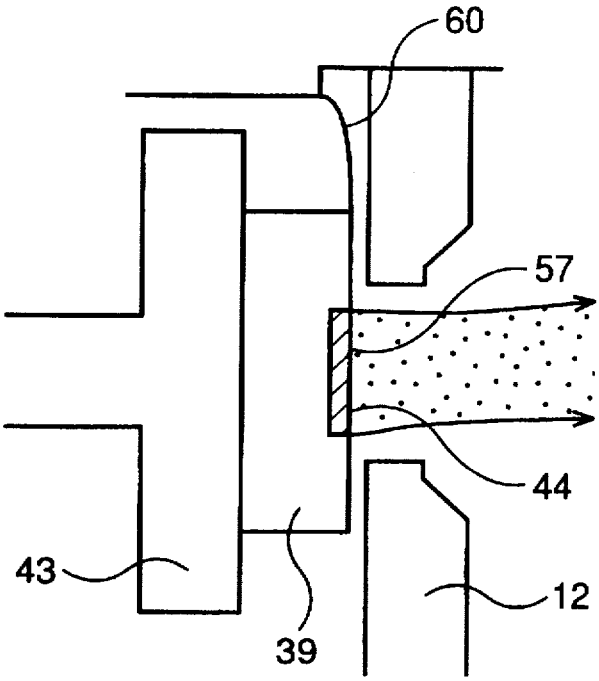
FIG. 1 PRIOR ART
FIG. 1 is a sectional view showing a prior art electron gun using a cold cathode electrode.
Figure 2:
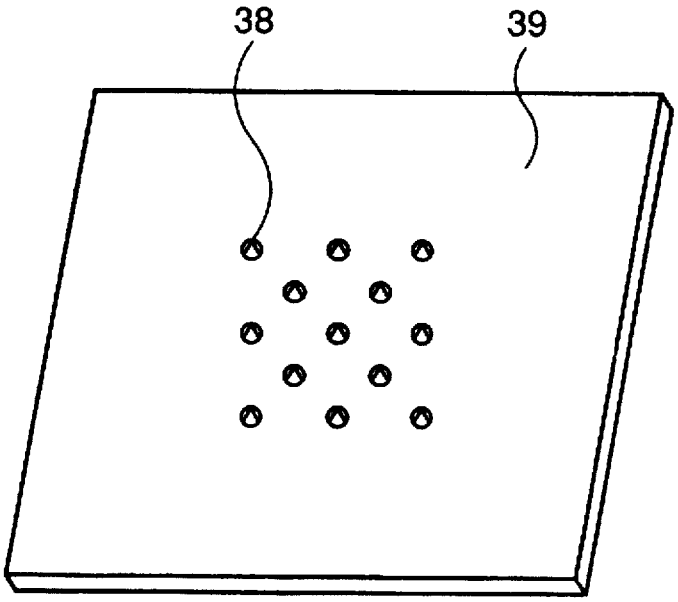
FIG. 2 PRIOR ART
FIG. 2 is a perspective view showing a cold cathode chip obtained by a semiconductor process.
Figure 3:
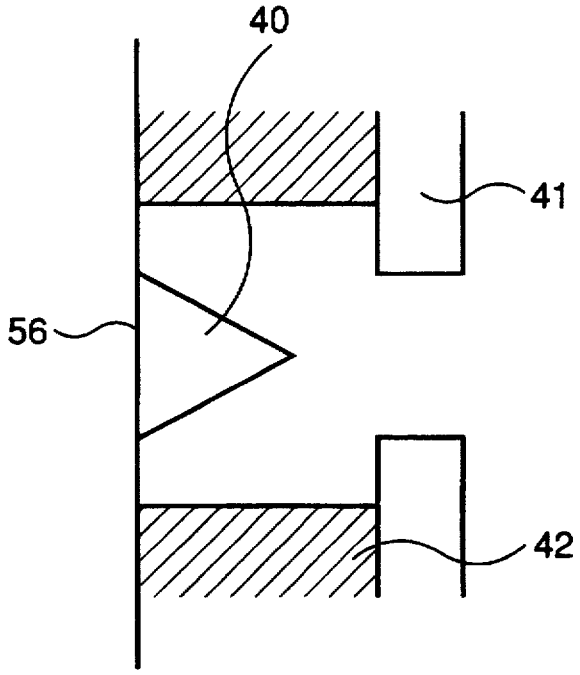
FIG. 3 PRIOR ART
FIG. 3 is an enlarged-scale sectional view showing the cold cathode electrode.

The electron gun section is made of the following materials. Referring to FIG. 3, the cold cathode electrode 44 is formed by using silicon typically for the base substrate 56, molybdenum or tungsten for the conical emitter 40, $SiO_2$ or the like for the insulating film 42 and molybdenum or the like for the gate electrode 41. The beam focusing electrode 12 is made of molybdenum, and its portions in contact with the cathode chip 39 is gold plated. Referring to FIG. 4, the anode 11 for accelerating the electron beam 2 is made of molybdenum and, in order to have the breakdown voltage property taken into account, its surface facing the beam focusing electrode 12 is mirror finished with an abrasive or the like.

The first embodiment described above has the following effects. Referring to FIG. 4, since the cathode chip 39 is secured by brazing in abutment to the mount support 43 such that it is in contact with a reference position of the mount support, the cold cathode electrode 44 can produce an electron beam 2 having a desired shape without axial deviation.

In addition, with the setting of the hole diameter of the beam focusing electrode 12 to be smaller than the electron emission region 57, it is possible to take out an electron beam 2 whose diameter is in conformity with the diameter of the hole of the beam focusing electrode 12. Furthermore, since the cathode chip 39 is secured with the beam focusing electrode 12 in direct contact with it, it can be connected to the gate electrode 41 shown in FIG. 3 without need of any lead take-out processes such as wire bonding process.

Figure 12:
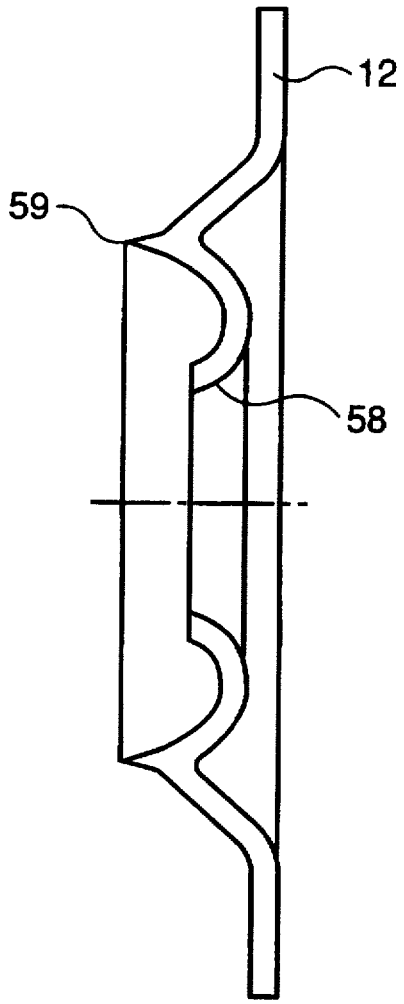
FIG. 12 is a sectional view showing a beam focusing electrode used in a second embodiment of the invention.
Figure 13:
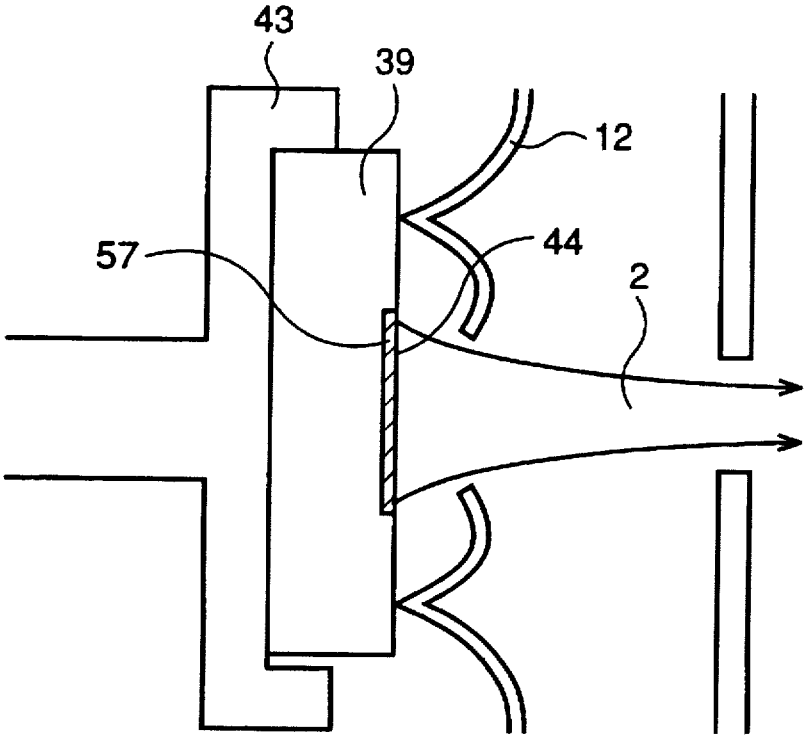
FIG. 13 is a sectional view showing an electron gun section of the linear beam microwave tube according to the second embodiment of the invention.

FIGS. 12 and 13 are sectional views showing an electron gun section of the linear beam microwave tube according to a second embodiment of the invention, the views specifically showing a cold cathode electrode 44, a cathode chip 39 therefor, a mount support 43 and a beam focusing electrode 12 for converging an electron beam 2. This second embodiment is different from the preceding first embodiment in the shape of a portion of the beam focusing electrode 12 that is in contact with the cathode chip 39. In the above first embodiment, the portion of the beam focusing electrode 12 that is in contact with the cathode chip 39 as shown in FIGS. 4 and 6, was curved over the entire circumference of it to provide for contact between the plane and the curved surface. In contrast, in the second embodiment shown in FIG. 13, the portion of the beam focusing electrode 12 that is in contact with the cathode chip 39 has a sharp angle to provide for contact between the plane and the curved line (i.e., point contact in a cross-sectional view).

The shape of the beam focusing electrode in the first embodiment is suited for obtaining the beam focusing electrode 12 having a desired shape with a press or like fabrication means. The shape of the beam focusing electrode in the second embodiment, on the other hand, requires that a portion of the beam focusing electrode 12, which has been fabricated with a press or like means, be shaped to a sharp angle in a subsequent process using a lathe or the like of high processing accuracy. However, the beam focusing electrode 12 that is fabricated by incorporating the above subsequent step, as shown in FIG. 12, can ensure far higher concentricity and dimensional accuracy of its hole periphery 58 and sharp angle portion 59 as compared to those in the case of the sole press fabrication.

Since the beam focusing electrode shape according to the first embodiment is mainly based on the press fabrication, it is suited for fabricating the beam focusing electrode 12 itself by mass production. The beam focusing electrode shape according to the second embodiment, although it is disadvantageous for mass production due to the need for the additional process, has many merits in the standpoints of positioning the electron gun and obtaining an electron beam having a desired shape. Particularly, it is suited for obtaining an electron beam which is stabler and having more satisfactory laminar flow property.

As has been described in the foregoing, according to the invention, the electron gun in the linear beam microwave tube uses the cold cathode electrode which does not require any heater, and the cathode chip carrying the cold cathode electrode is abutted and brazed to the mount support and thus positioned with respect to a reference position so as to meet a desired dimension. In addition, since the hole diameter of the beam focusing electrode is set to be smaller than the electron emission region, it is possible to take out an electron beam having a circular sectional profile in exact conformity with the hole diameter of the beam focusing electrode. Moreover, since the cathode chip is secured with the beam focusing electrode in direct contact with it, it is possible to connect the gate electrode without need of any wire bonding process. These advantages permit a circular electron beam to be taken out from a position which has been set with respect to a reference position and in a manner which requires simple construction.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A linear beam microwave tube having an electron gun section serving as an electron beam source, a high frequency circuit section including a slow-wave circuit for causing interaction between an electron beam and a microwave, and a collector section for collecting the electron beam produced as a result of the interaction process in said high frequency circuit section, said linear beam microwave tube comprising:

a cathode chip having a planar cold cathode electrode disposed thereon and having no heater in said electron gun section and having an electron emission region; and a beam focusing electrode being in direct contact with a surface of said cathode chip and disposed in front of said planar cold cathode electrode, said beam focusing electrode having a concave portion on a side opposite to said planar cold cathode electrode and having a hole whose diameter is smaller than said electron emission region of said planar cold cathode electrode.

2. A linear beam microwave tube according to claim 1, in which said cathode chip is abutted and brazed to a reference face of a mount support in said electron gun section.

3. A linear beam microwave tube according to claim 1, in which said beam focusing electrode has a curved surface region which is in direct contact with and brazed to a plane surface of said cathode chip.

4. A linear beam microwave tube according to claim 3, in which said curved surface region is provided with indium plating.

5. A linear beam microwave tube according to claim 1, in which said beam focusing electrode has a sharp angled surface region which is in direct contact with and brazed to a plane surface of said cathode chip.

* * * * *